US011309648B1

(12) United States Patent
Huang

(10) Patent No.: US 11,309,648 B1
(45) Date of Patent: Apr. 19, 2022

(54) CONNECTOR STRUCTURE WITH IMPROVED TERMINAL COPLANARITY

(71) Applicant: Industrial Technology Research Institute, Hsinchu (TW)

(72) Inventor: Tien-Fu Huang, Hsinchu County (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 3 days.

(21) Appl. No.: 17/134,609

(22) Filed: Dec. 28, 2020

(30) Foreign Application Priority Data

Nov. 10, 2020 (TW) ..... 109139209

(51) Int. Cl.

| | |
|---|---|
| ***H01R 12/72*** | (2011.01) |
| ***H01R 13/514*** | (2006.01) |
| ***H01R 12/70*** | (2011.01) |
| ***H01R 13/631*** | (2006.01) |
| *H01R 43/02* | (2006.01) |
| *H01R 12/57* | (2011.01) |

(52) U.S. Cl.
CPC ..... *H01R 12/725* (2013.01); *H01R 12/7052* (2013.01); *H01R 13/514* (2013.01); *H01R 13/631* (2013.01); *H01R 12/57* (2013.01); *H01R 43/0256* (2013.01)

(58) Field of Classification Search
CPC ..... H01R 12/725; H01R 12/7052; H01R 13/514; H01R 13/631; H01R 12/57; H01R 43/0256
See application file for complete search history.

(56) References Cited

U.S. PATENT DOCUMENTS 6,095,826 A * 8/2000 Potters ..... H01R 12/724 439/79
9,843,116 B2 * 12/2017 Endo ..... H01R 12/585
(Continued)

FOREIGN PATENT DOCUMENTS

CN 201430256 Y 3/2010
CN 102210063 A 10/2011
(Continued)

OTHER PUBLICATIONS

TW OA issued on May 7, 2021.

*Primary Examiner* — Travis S Chambers
(74) *Attorney, Agent, or Firm* — WPAT, PC

(57) ABSTRACT

A connector structure with improved terminal coplanarity includes a housing and terminal assemblies. The housing has sockets and a coplanar track. The coplanar track is defined by two inner flanges of the housing. The two flanges extend longitudinally and parallel to each other. Each terminal assembly includes a connector body, terminals and a guider. The connector body is disposed inside the housing by the sockets. The terminals are disposed by penetrating through the connector body. The guider is disposed close to soldering ends of the terminals. The soldering end of each terminal protrudes out of the guider. The guider has two opposite grooves. Each groove is engaged with the corresponding flange. The coplanar track has a coplanar datum surface. Soldering portions of the soldering ends of the terminals protruding out of the guider are separated from the coplanar datum surface by the same distance.

9 Claims, 10 Drawing Sheets

(56) References Cited

U.S. PATENT DOCUMENTS

| | | | | |
|---|---|---|---|---|
| 10,056,710 | B1 | 8/2018 | Yang | |
| 11,211,745 | B2 * | 12/2021 | Torrey | H01R 13/6273 |

FOREIGN PATENT DOCUMENTS

| | | | | |
|---|---|---|---|---|
| CN | 106611907 | A | | 5/2017 |
| CN | 206685619 | U | | 11/2017 |
| CN | 107645084 | A | | 1/2018 |
| CN | 208706932 | U | | 4/2019 |
| CN | 208849100 | U | | 5/2019 |
| CN | 208862209 | U | | 5/2019 |
| CN | 109982504 | A | | 7/2019 |
| CN | 110247237 | A | | 9/2019 |
| CN | 110600932 | A | | 12/2019 |
| JP | 2000500272 | A | * | 1/2000 |
| TW | 520100 | | | 2/2003 |
| TW | M356296 | | | 5/2009 |
| TW | I509903 | | | 11/2015 |
| TW | I527318 | | | 3/2016 |

* cited by examiner

CONNECTOR STRUCTURE WITH IMPROVED TERMINAL COPLANARITY

CROSS REFERENCE TO RELATED APPLICATION

This application claims the benefits of Taiwan application Serial No. 109139209, filed Nov. 10, 2020, the disclosures of which are incorporated by references herein in its entirety.

TECHNICAL FIELD

The present disclosure relates in general to a soldering technology of electronic connectors, and more particularly to a connector structure with improved terminal coplanarity.

BACKGROUND

In manufacturing electronic products, the surface mount technology (SMT) is one of key steps. The quality of soldering or welding has an important impact on the strength of the connector, and even the functionality thereof. In an electronic connector, one important factor to determine the soldering quality of the SMT is the coplanarity of SMT terminals of the connector. By comparing an angular-type connector with a straight-type connector, coplanarity of SMT terminals of the angular-type connector is particularly concerned since the SMT terminals thereof are separately and individually mounted. If the coplanarity is a problem, then the quality of the SMT process would be affected. By providing a new structure design to improve coplanarity of the connector, the stability and yield of the SMT process can be significantly enhanced.

In general, the electronic connector and the corresponding printed circuit board are usually assembled together by soldering. In the past, though the through-hole technology (THT) can provide sufficient soldering strength, yet a larger application room is a problem. As the dimension of product goes smaller and smaller, and components on the printed circuit board become more and more complicated, the SMT becomes the mainstream soldering technique to meet various industrial requirements. In a typical SMT process, the yield of the process is highly dependent upon the coplanarity of the SMT terminals, and it is understood that the coplanarity of the SMT terminals is mainly determined by the solder wetting degree.

The coplanarity of the SMT terminals of the straight-type electronic connector can be controlled by the assembly depth of the pin. On the other hand, in the angular-type electronic connector, since different productions and mounting layers of the terminals and the plastic housings, assembly tolerances may be accumulated to degrade the coplanarity.

Currently, the coplanarity of the angular-type electronic connector is usually controlled by strict production demands upon the configuration of the terminals. With the aforesaid demands in configurations and the different mounting between individual terminals and the corresponding plastic housings, the accumulated tolerances might worsen the coplanarity. Especially, when the angular-type electronic connector includes at least two mounting layers, the control in coplanarity would become uncontrollable.

Accordingly, an issue of providing a connector structure with improved terminal coplanarity is urgent to be resolved for the skill in the art.

SUMMARY

In one embodiment of this disclosure, a connector structure with improved terminal coplanarity includes a housing and a plurality of terminal assemblies.

The housing has thereinside a plurality of sockets and a coplanar track disposed at a bottom thereof. The coplanar track is defined by two flanges disposed individually inside to two opposite lateral sides of the housing. Each of the two flanges is longitudinally extended in a longitudinal direction and parallel to each other.

Each of the plurality of terminal assemblies includes a connector body, a plurality of terminals and a guider.

The connector body is disposed inside the housing by the plurality of sockets.

The plurality of terminals are disposed by penetrating through the connector body.

The guider is disposed close to soldering ends of the plurality of terminals. The soldering end of each of the plurality of terminals protrudes out of the guider. The guider has two opposite sides, and each of the two opposite sides is furnished with a groove. When the guider is disposed at the coplanar track, each of the two grooves of the guider is engaged with the corresponding flange. The coplanar track has a coplanar datum surface disposed on a bottom surface thereof. Soldering portions of the soldering ends of the plurality of terminals protruding out of the guider are separated from the coplanar datum surface by the same distance.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
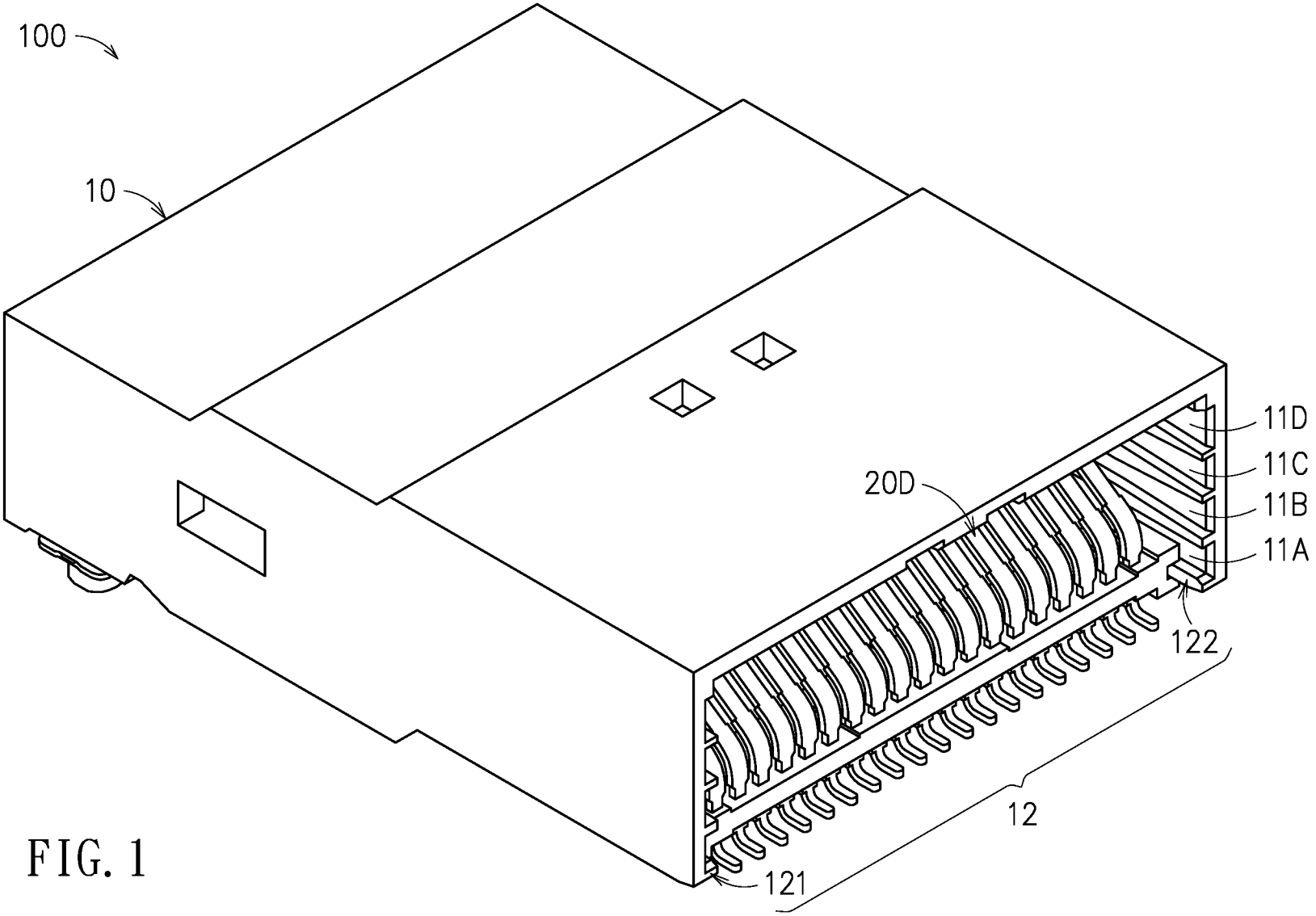
FIG. 1 is a schematic perspective view of an embodiment of the connector structure with improved terminal coplanarity in accordance with this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
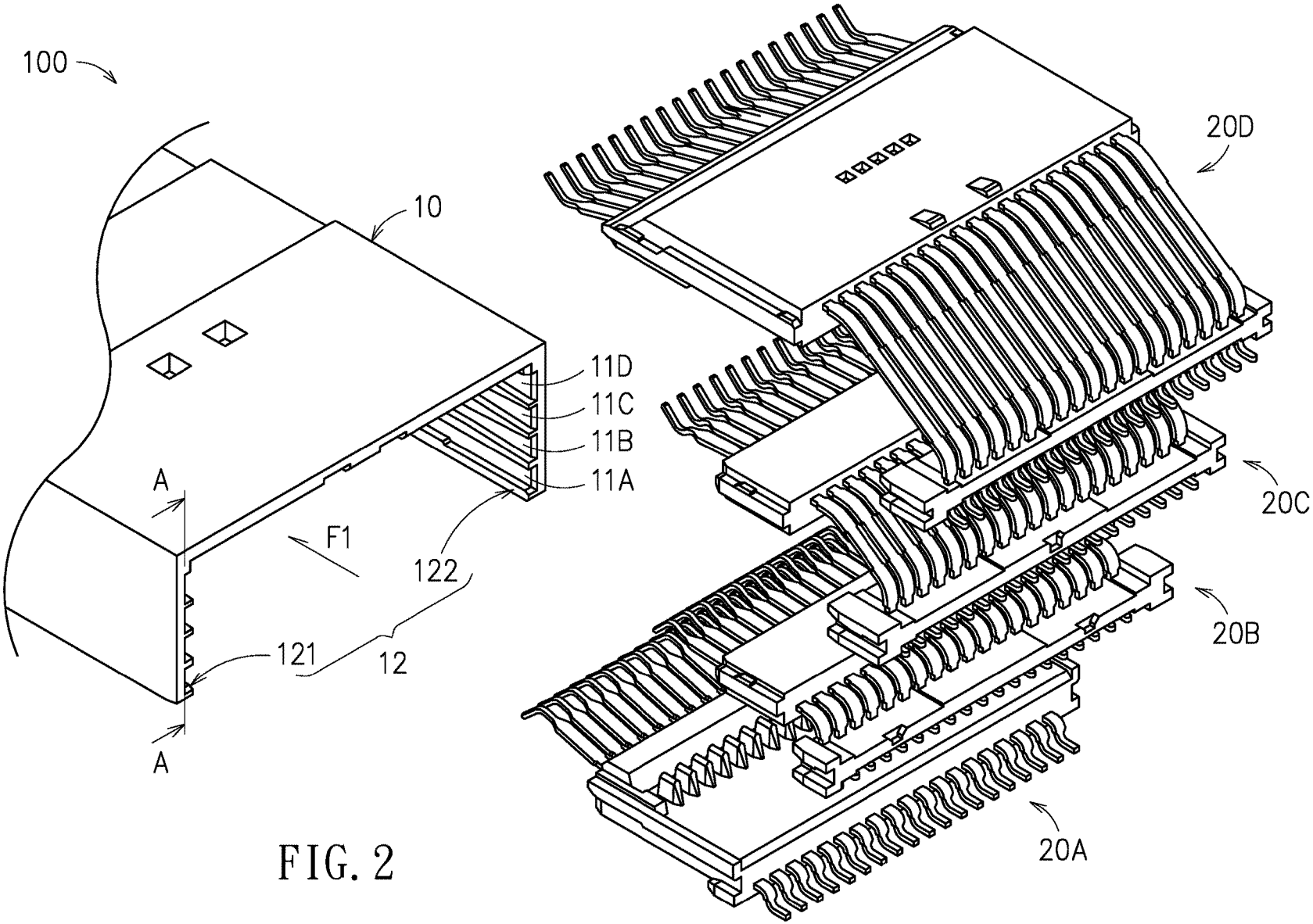
FIG. 2 is a schematic exploded view of FIG. 1.

Referring to FIG. 1 and FIG. 2, a connector structure with improved terminal coplanarity 100 of this disclosure includes a housing 10, a first terminal assembly 20A, a second terminal assembly 20B, a third terminal assembly 20C and a fourth terminal assembly 20D.

The housing 10 is structured thereinside to form a first socket 11A, a second socket 11B, a third socket 11C, a fourth socket 11D and a coplanar track 12 at a bottom of the housing 10. The housing 10 can be made of a plastic insulation material.

The coplanar track 12 is defined by two inner flanges 121, 122 of the housing 10. The two flanges 121, 122 are disposed individually inside to two opposite lateral sides of the housing 10. In this embodiment, the two flanges 121, 122 are symmetrically disposed to opposite sides of the housing 10. Each of the flanges 121, 122 is longitudinally extended in a longitudinal direction F1 and parallel to each other. In the following description, elucidations and applications upon the flanges 121, 122 in one embodiment can be also applied to flanges 121, 122 in another embodiment.

Figure 3:
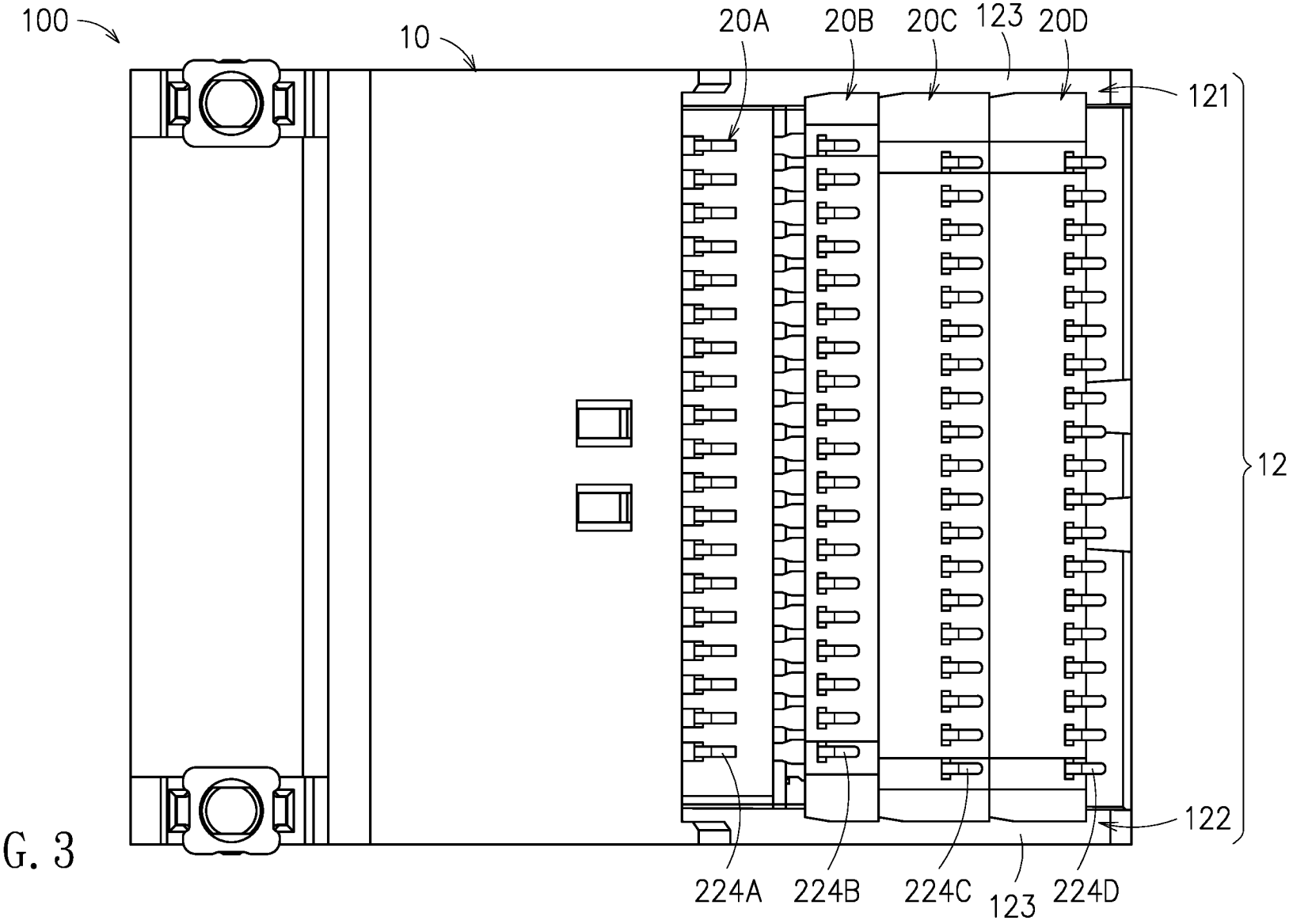
FIG. 3 is a schematic bottom view of FIG. 1.
Figure 4:
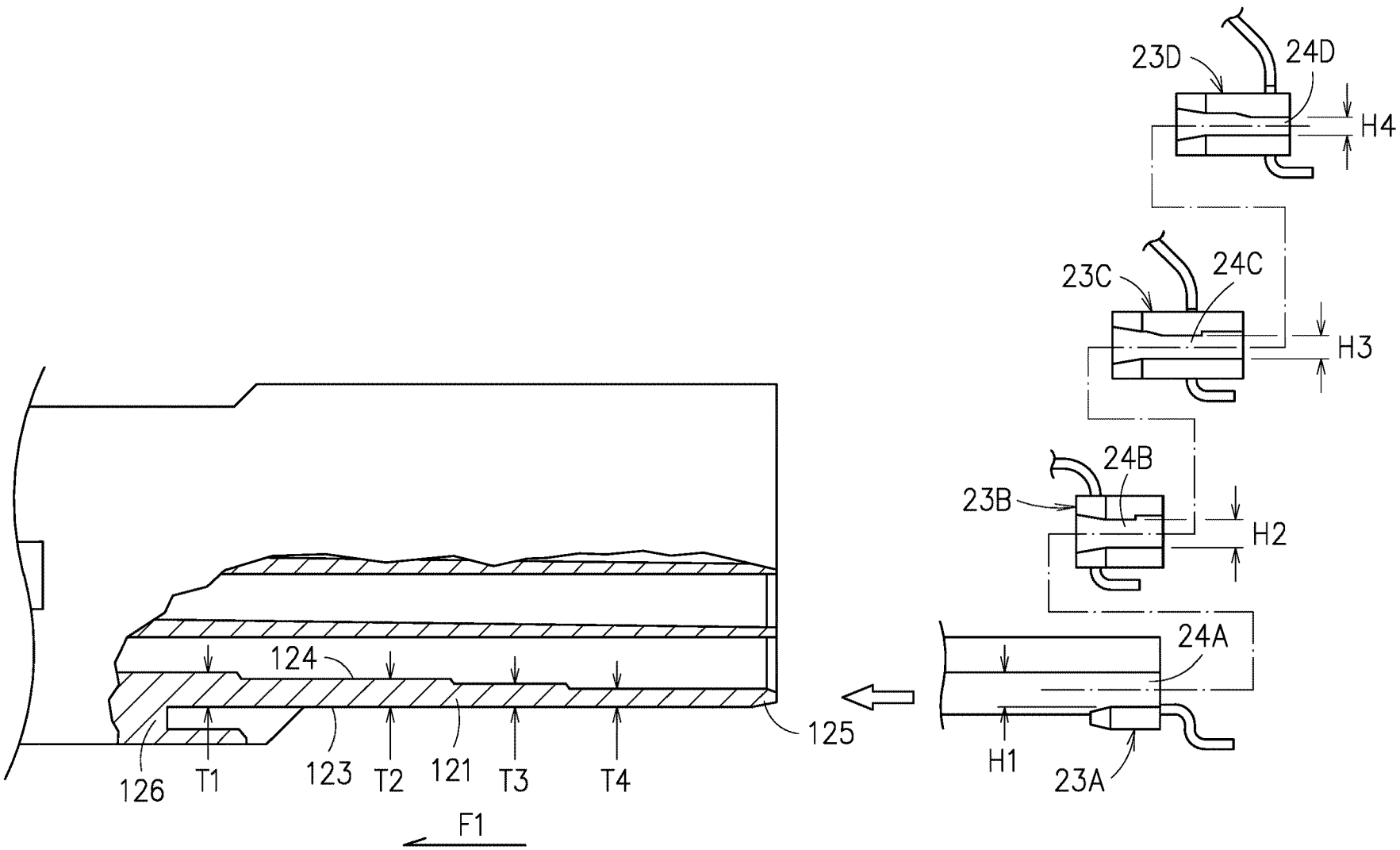
FIG. 4 is a schematic view of part of FIG. 2 by removing a portion of the side at line A-A and demonstrating different guiders to fit the coplanar track.

Referring to FIG. 3 and FIG. 4, by having the flange 121 as an example, the flange 121 extending in the longitudinal direction F1 has a coplanar datum surface 123 (bottom surface) and a top surface 124 opposing the datum surface 123. Namely, a bottom of any of the flanges 121, 122 is the coplanar datum surface 123. In this embodiment, the coplanar datum surface 123 is a plane, while the top surface 124 is a stepped surface extending in the longitudinal direction F1.

In the longitudinal direction F1, the flange 121 has a first end 125 and a second end 126 opposing the first end 125. Thickness of the flange 121 is increasing from the first end 125 to the second end 126. As shown, from the first end 125 to the second end 126, the flange 121 is stepwise structured to have a plurality of thicknesses T4, T3, T2, and T1.

Figure 2A:
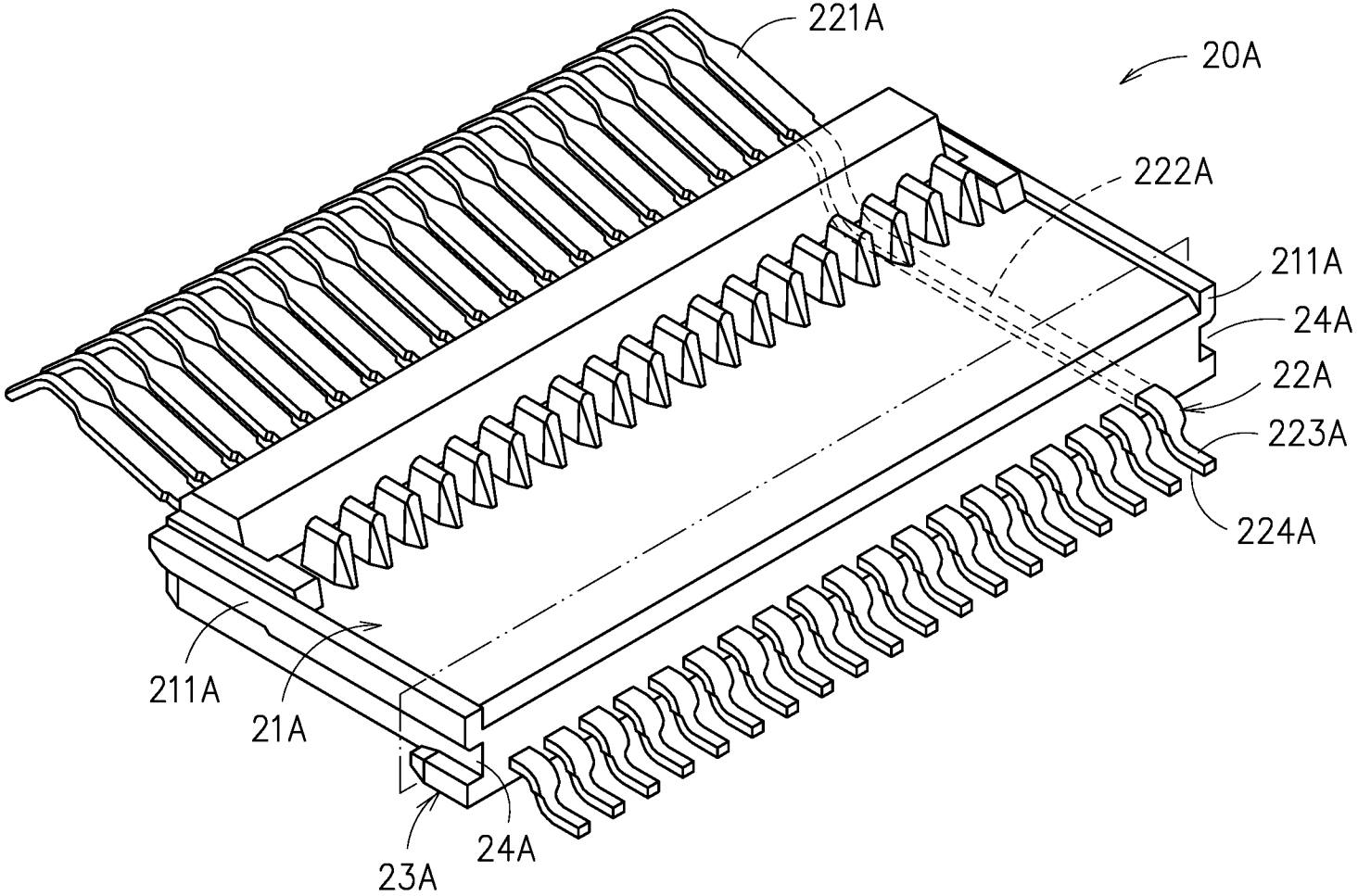
FIG. 2A is a schematic perspective view of the first terminal assembly of FIG. 1.

Referring to FIG. 2 and FIG. 2A~2D, in the connector structure with improved terminal coplanarity 100 provided by this disclosure, the first terminal assembly 20A includes a first connector body 21A, a plurality of first terminals 22A and a first guider 23A. The first connector body 21A and the first guider 23A are integrally formed as a single component, but, for an illustrative purpose, with a double-dot dashed line to indicate the boundary between the first connector body 21A and the first guider 23A as shown in FIG. 2A. The second terminal assembly 20B includes a second connector body 21B, a plurality of second terminals 22B and a second guider 23B. The second connector body 21B and the second guider 23B are separated into two discrete pieces. The third terminal assembly 20C includes a third connector body 21C, a plurality of third terminals 22C and a third guider 23C. The third connector body 21C and the third guider 23C are separated into two discrete pieces. The fourth terminal assembly 20D includes a fourth connector body 21D, a plurality of fourth terminals 22D and a guider 23D. The fourth connector body 21D and the fourth guider 23D are also separated into two pieces.

The first terminals 22A, the second terminals 22B, the third terminals 22C and the fourth terminals 22D can be made of a conductive metal material. The first connector body 21A, the second connector body 21B, the third connector body 21C, the fourth connector body 21D, the first guider 23A, the second guider 23B, the third guider 23C and the fourth guider 23D can be made of a plastic insulation material.

In this embodiment, the first connector body 21A, the second connector body 21B, the third connector body 21C and the fourth connector body 21D are all similarly and all roughly shaped into a flat rectangular shape. The first connector body 21A has two opposite sides furnished respectively with two first horizontal flanges 211A, the second connector body 21B has two opposite sides furnished respectively with two second horizontal flanges 211B, the third connector body 21C has two opposite sides furnished respectively with two third horizontal flanges 211C, and the fourth connector body 21D also has two opposite sides furnished respectively with two fourth horizontal flanges 211D.

The first guider 23A has two opposite sides furnished respectively with two first longitudinal grooves 24A, the second guider 23B has two opposite sides furnished respectively with two second longitudinal grooves 24B, the third guider 23C has two opposite sides furnished respectively with two third longitudinal grooves 24C, and the fourth guider 23D has two opposite sides furnished respectively with two fourth longitudinal grooves 24D.

Since the first connector body 21A and the first guider 23A are connected with each other and integrally formed as a single component, the first horizontal flange 211A of the first connector body 21A is extended further to top the first guider 23A (i.e., by forming the top portion of the first longitudinal groove 24A). As shown in FIG. 2A, the first longitudinal groove 24A is defined by the lower portion and upper portion of the first guider 23A. In other words, in the first terminal assembly 20A, the first guider 23A and the first connector body 21A are integrally as a single component by having the first guider 23A to locate at a front side of the first connector body 21A.

Referring to FIG. 2A and FIG. 3, each of the first terminals 22A is consisted of a first front section 221A, a first middle section 222A and a first rear section 223A, electrically connected with each other. Each of the first terminals 22A is disposed by penetrating through the first connector body 21A and the first guider 23A, by having the first connector body 21A and the first guider 23A to dispose between the first front section 221A and the first rear section 223A. The first middle section 222A is wrapped inside the first connector body 21A. One free end of the first front section 221A (i.e., another end of the first terminals 22A opposing the first rear section 223A) is protrusive out of one side of the first connector body 21A. The first rear section 223A protrudes out of the first guider 23A and is bent downward. The first rear section 223A, as a soldering end of the first terminals 22A, has a first soldering portion 224A for being soldered onto a surface of a printed circuit board (not shown in the figure). The first soldering portion 224A is a plane extending in the longitudinal direction and parallel to the horizontal surface.

Figure 2B:
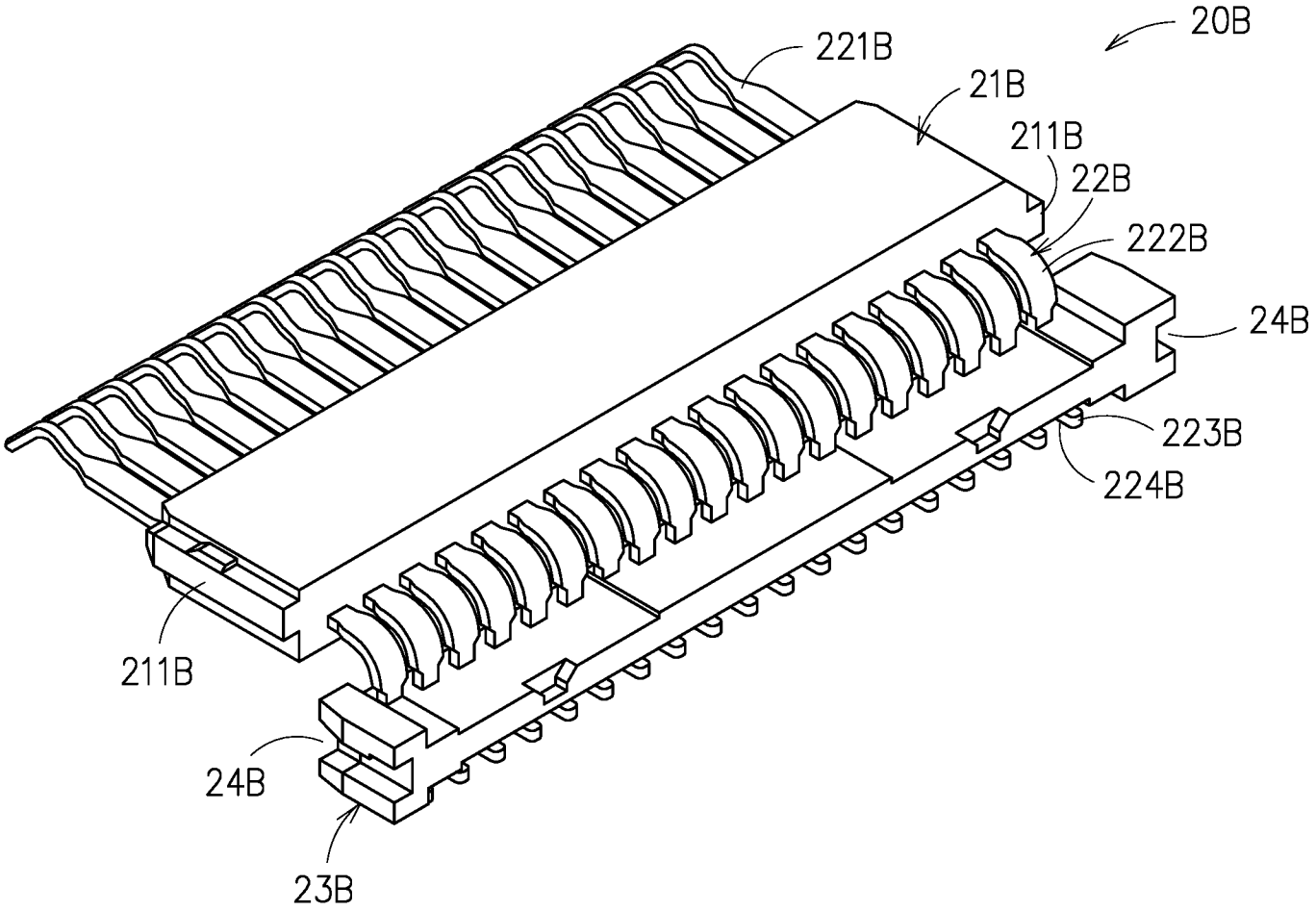
FIG. 2B is a schematic perspective view of the second terminal assembly of FIG. 1.

Referring to FIG. 2B and FIG. 3, each of the second terminals 22B is consisted of a second front section 221B, a second middle section 222B and a second rear section 223B, electrically connected with each other. Each of the second terminals 22B is disposed by penetrating through the second connector body 21B. The second connector body 21B is located between the second front section 221B and the second middle section 222B. The second front section 221B has a free end (i.e., another end of the second terminal 22B opposing the second rear section 223B) to protrude out of one side of the second connector body 21B. The second guider 23B is located between the second middle section 222B and the second rear section 223B. The second rear section 223B protrudes out of a surface (bottom surface) of the second guider 23B. The second middle section 222B is protruded out of another side of the second connector body 21B. The second rear section 223B, as the soldering end of the second terminal 22B, has a second soldering portion 224B for being soldered onto a surface of a printed circuit board (not shown in the figure). The second soldering portion 224B is a plane extending in the longitudinal direction and parallel to the horizontal surface.

Figure 2C:
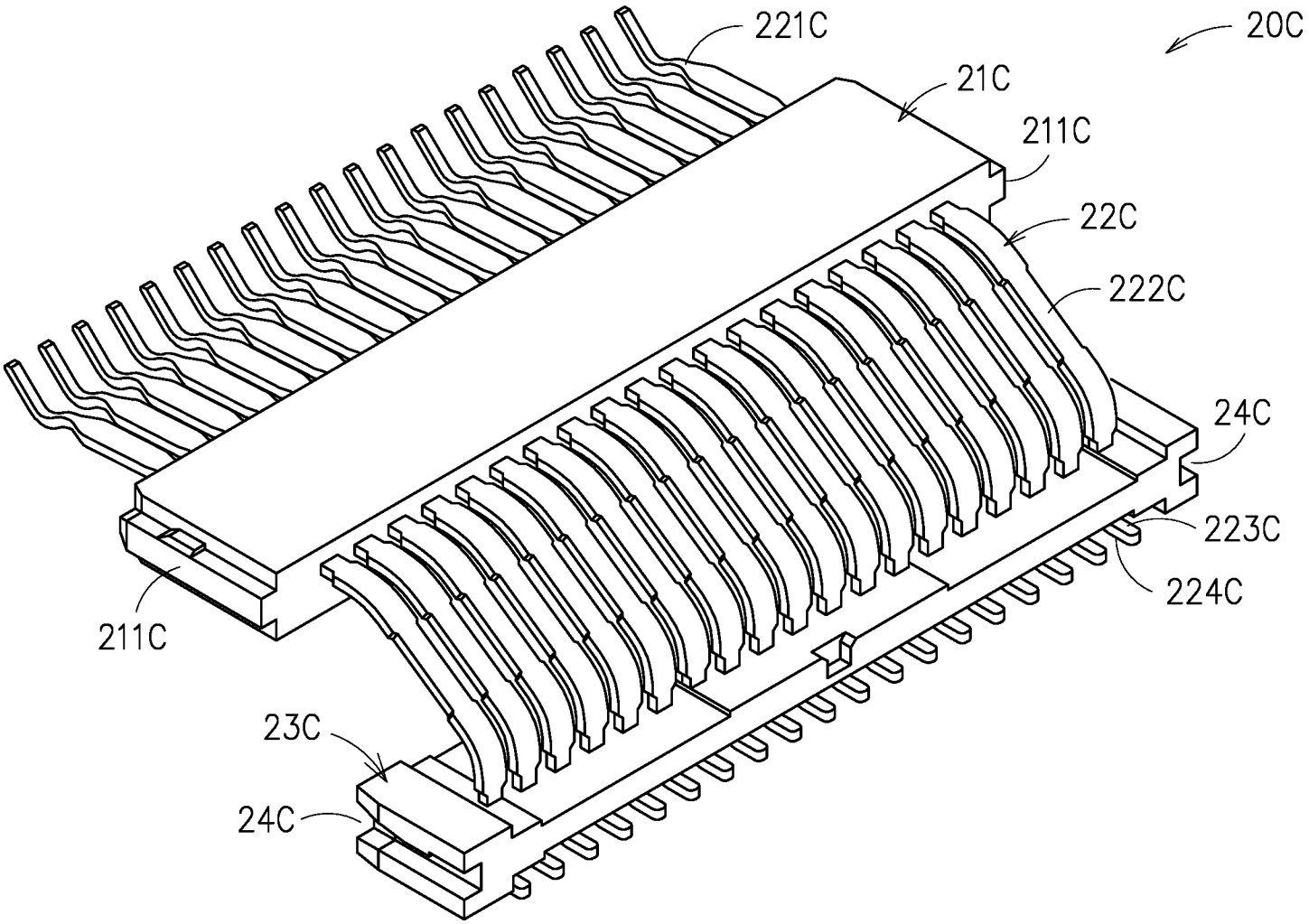
FIG. 2C is a schematic perspective view of the third terminal assembly of FIG. 1.

Referring to FIG. 2C and FIG. 3, each of the third terminals 23C is consisted of a third front section 221C, a third middle section 222C and a third rear section 223C, electrically connected with each other. Each of the third terminals 22C is disposed by penetrating through the third connector body 21C. The third connector body 21C is located between the third front section 221C and the third middle section 222C. The third front section 221C has a free end (i.e., another end of the third terminal 22C opposing the third rear section 223C) to protrude out of one side of the third connector body 21C. The third guider 23C is located between the third middle section 222C and the third rear section 223C. The third rear section 223C protrudes out of a surface (bottom surface) of the third guider 23C. The third middle section 222C is protruded out of another side of the third connector body 21C and bent downward. The third rear section 223C, as the soldering end of the third terminal 22C, has a third soldering portion 224C for being soldered onto a surface of a printed circuit board (not shown in the figure). The third soldering portion 224C is a plane extending in the longitudinal direction and parallel to the horizontal surface.

Figure 2D:
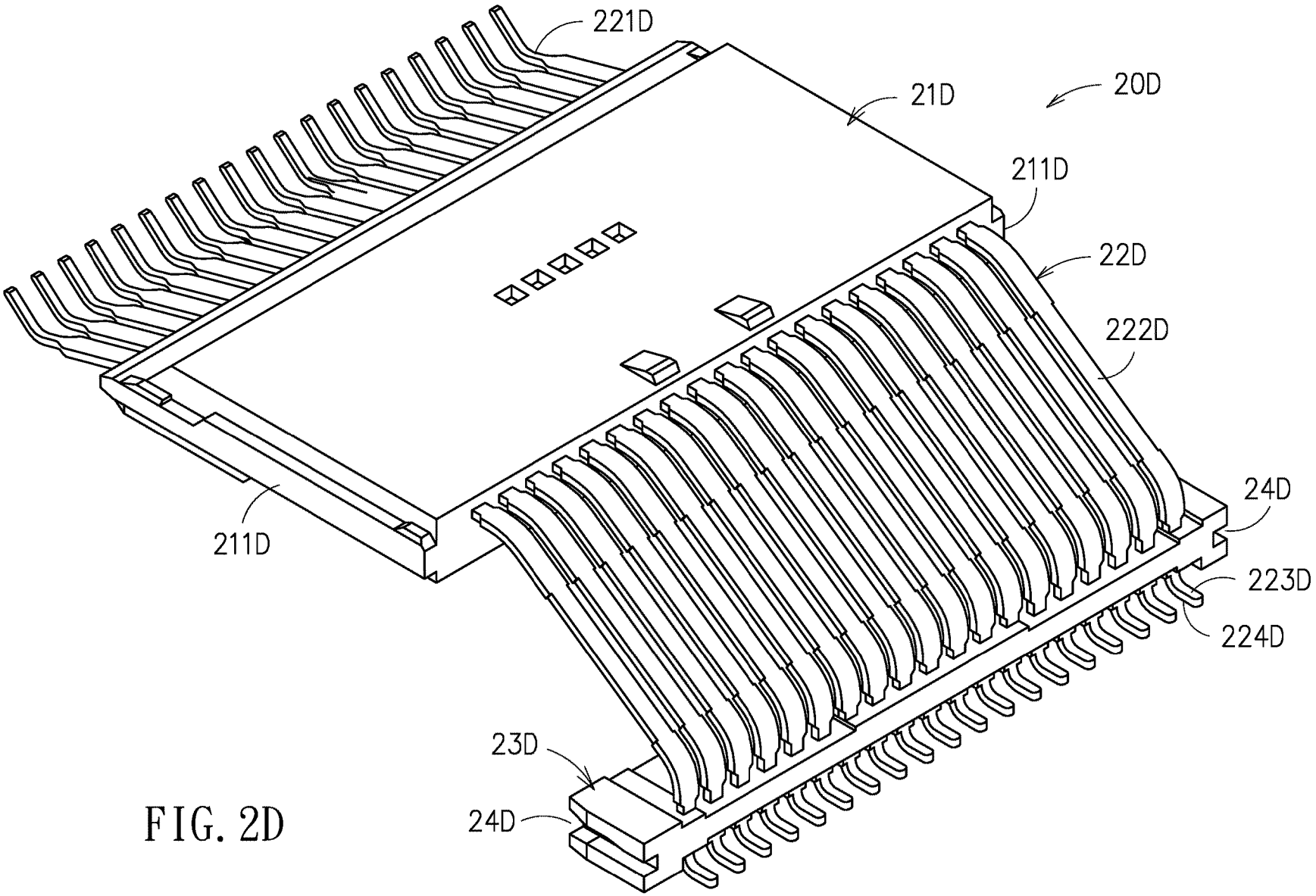
FIG. 2D is a schematic perspective view of the fourth terminal assembly of FIG. 1.

Referring to FIG. 2D and FIG. 3, each of the fourth terminals 23D is consisted of a fourth front section 221D, a fourth middle section 222D and a fourth rear section 223D, electrically connected with each other. Each of the fourth terminals 22D is disposed by penetrating through the fourth connector body 21D. The fourth connector body 21D is located between the fourth front section 221D and the fourth middle section 222D. The fourth front section 221D has a free end (i.e., another end of the fourth terminal 22D opposing the fourth rear section 223D) to protrude out of one side of the fourth connector body 21D. The fourth middle section 222D protrudes out of another side of the fourth connector body 21D. The fourth guider 23D is located between the fourth middle section 222D and the fourth rear section 223D. The fourth rear section 223D protrudes out of a surface of the fourth guider 23D. The fourth rear section 223D, as the soldering end of the fourth terminal 22D, has a fourth soldering portion 224D for being soldered onto a surface of a printed circuit board (not shown in the figure). The fourth soldering portion 224D is a plane extending in the longitudinal direction and parallel to the horizontal surface.

As shown in FIGS. 2 and 2A~2D, a conductive length of the second middle section 222B is less than that of the third middle section 222C, and the conductive length of the third middle section 222C is less than that of the fourth middle section 222D. In one embodiment, the first rear section 223A is shaped to be an "S" form, and protrudes out of the first guider 23A from a lateral side thereof. On the other hand, the second rear section 223B, the third rear section 223C and the fourth rear section 223D are all shaped to be "L" forms, and protrude out of corresponding bottoms of the second guider 23B, the third guider 23C and the fourth guider 24D, respectively.

By inserting the first horizontal flanges 211A into the corresponding first sockets 11A, then the first connector body 21A as well as the first front sections 221A of the corresponding first terminals 22A can be positioned into the housing 10.

By inserting the second horizontal flanges 211B into the corresponding second sockets 11B, then the second connector body 21B as well as the second front sections 221B of the corresponding second terminals 22B can be positioned into the housing 10.

By inserting the third horizontal flanges 211C into the corresponding third sockets 11C, then the third connector body 21C as well as the third front sections 221C of the corresponding third terminals 22C can be positioned into the housing 10.

By inserting the fourth horizontal flanges 211D into the corresponding fourth sockets 11D, then the fourth connector body 21D as well as the fourth front sections 221D of the corresponding fourth terminals 22D can be positioned into the housing 10.

As shown in FIG. 2 and FIG. 2A, by having the two first grooves 24A to engage the two corresponding flanges 121, 122, then the first guider 23A as well as the first middle sections 222A and the first rear sections 223A of the first terminals 22A can be positioned into the housing 10.

As shown in FIG. 2 and FIG. 2B, by having the two grooves 24B to engage the two corresponding flanges 121, 122, then the second guider 23B as well as the second middle sections 222B and the second rear sections 223B of the second terminals 22B can be positioned into the housing 10.

As shown in FIG. 2 and FIG. 2C, by having the two grooves 24C to engage the two corresponding flanges 121, 122, then the third guider 23C as well as the third middle sections 222C and the third rear sections 223C of the third terminals 22C can be positioned into the housing 10.

As shown in FIG. 2 and FIG. 2D, by having the two grooves 24D to engage the two corresponding flanges 121, 122, then the fourth guider 23D as well as the fourth middle sections 222D and the fourth rear sections 223D of the fourth terminals 22D can be positioned into the housing 10.

As shown in FIG. 2 and FIG. 4, the flange 121 is structured in a stepwise manner to have a plurality of thicknesses T4, T3, T2, T1 therealong from the first end 125 to the second end 12. The first groove 24A, the second groove 24B, the third groove 24C and the fourth groove 24D of the guiders 23A, 23B, 23C, 23D, respectively, are corresponding to have groove heights H1, H2, H3, H4, respectively. Each of the thicknesses T4, T3, T2, T1 are to match the groove heights H1, H2, H3, H4, respectively. In particular, the thickness T4 is greater than the thickness T3, the thickness T3 is greater than the thickness T2, and the thickness T2 is greater than the thickness T1 (i.e., T1>T2>T3>T4). Each of the thicknesses T4, T3, T2, T1 is designed to fit the groove heights H1, H2, H3, H4 of the first guider 23A, the second guider 23B, the third guider 23C and the fourth guider 23D, respectively, such that the stepwise top surface 124 can accurately fit and position the first guider 23A, the second guider 23B, the third guider 23C and the fourth guider 23D.

Since the thicknesses T4, T3, T2, T1 of the flange 121 are increased from the first end 125 to the second end 126, and thus engagements at the first guider 23A, the second guider 23B, the third guider 23C and the fourth guider 23D shall follow a predetermined order.

Figure 5:
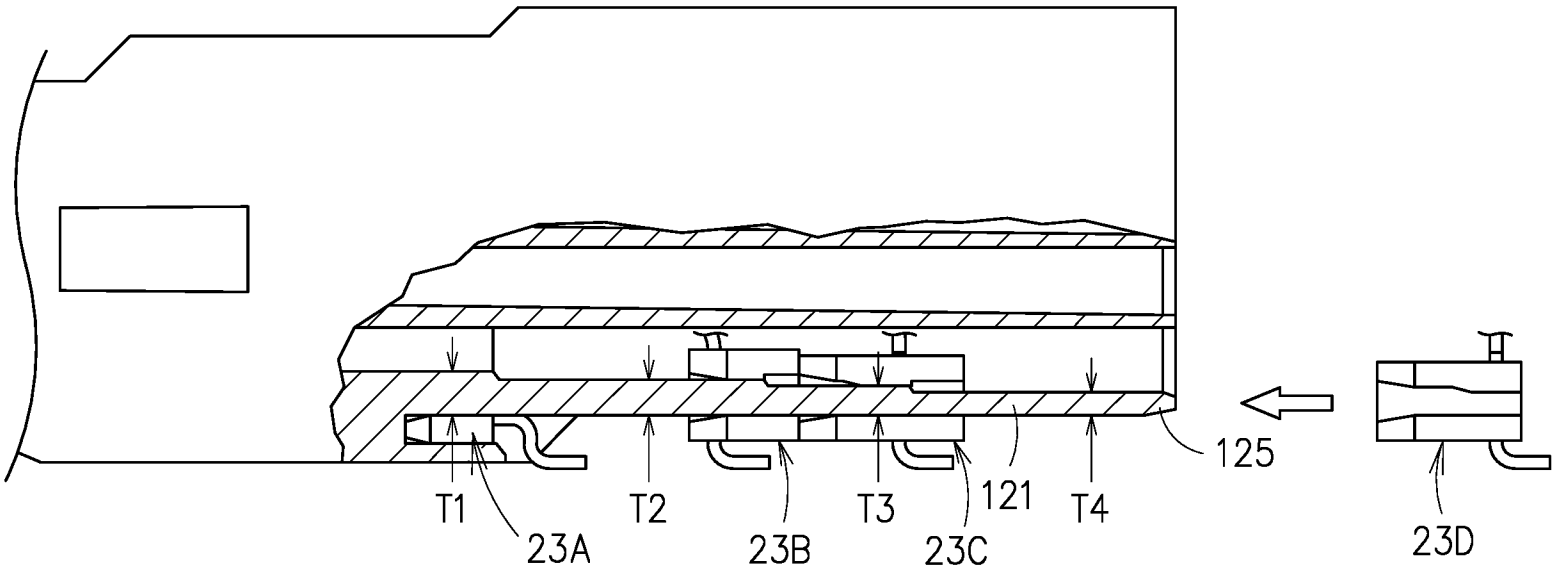
FIG. 5 demonstrates schematically order mounting of the guiders of FIG. 4.

Referring to FIG. 4 and FIG. 5, the first groove 24A of the first guider 23A has the biggest groove height H1, and thus the first guider 23A is firstly sent to slide along the flange 121 from the first end 125 thereof, such that the first groove 24A can reach a fix location at the second end 126 to fit the flange 121. In particular, the flange 121 with the thickness T1 presents a tight fit with the first groove 24A of the first guider 23A of the first terminal assembly 20A.

Then, the second guider 23B, the third guider 23C and the fourth guider 23D are orderly sent to slide along the flange 121 from the first end 125 thereof, such that the second groove 24B, the third groove 24C and the fourth groove 24D can form respective tight fits/engages with the flange 121 at the thicknesses T2, T3 and T4 thereof, respectively. As such, the first guider 23A, the second guider 23B, the third guider 23C and the fourth guider 23D can be fixedly mounted onto the coplanar track 12.

Figure 6:
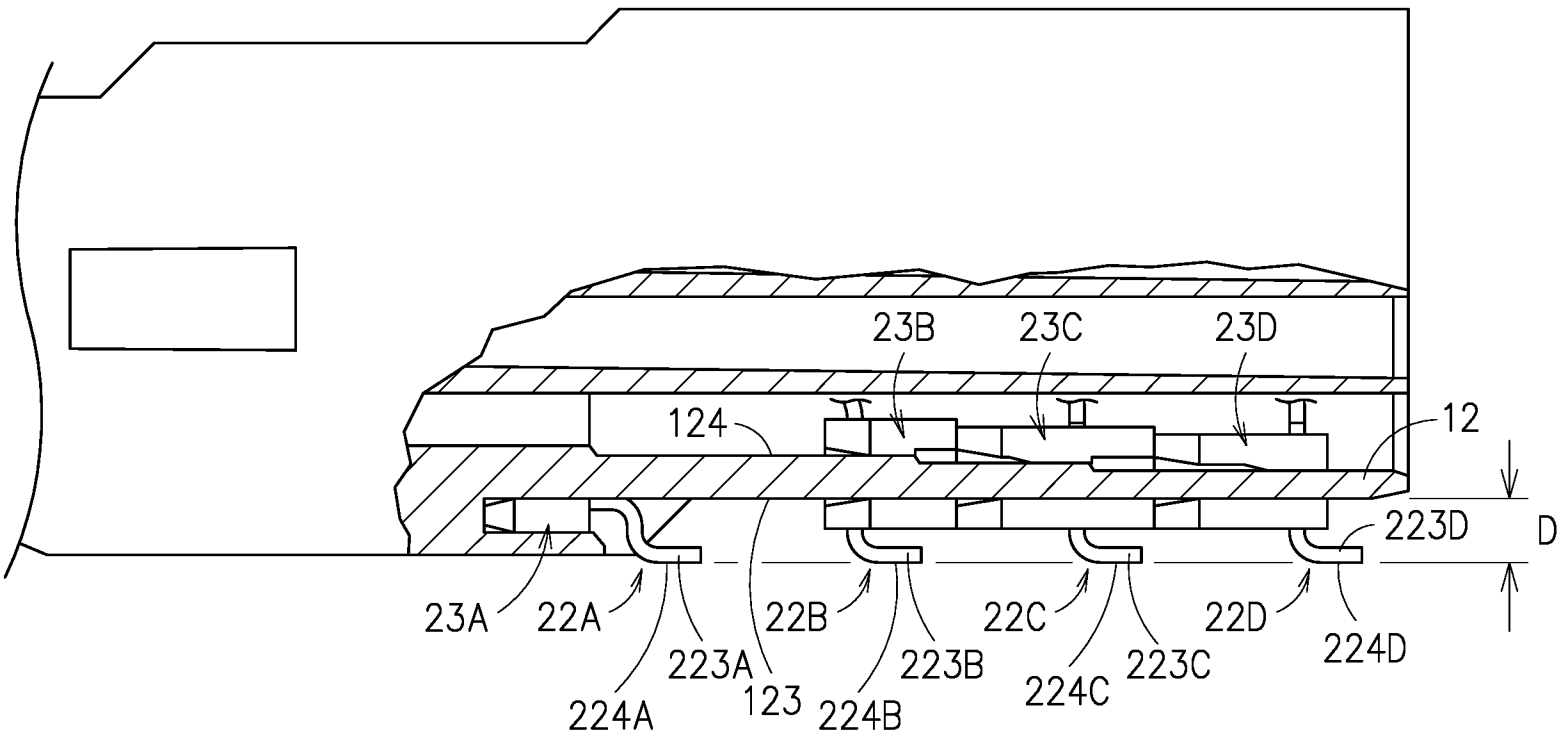
FIG. 6 demonstrates schematically all the guiders have been disposed to the coplanar track.

Referring to FIG. 6, the bottom of the coplanar track 12 is applied to be a coplanar datum surface 123. Then, all the soldering ends (i.e., the first rear section 223A, the second rear section 223B, the third rear section 223C and the fourth rear section 223D) of the terminals 22A, 22B, 22C, 22D of the terminal assemblies 20A, 20B, 20C, 20D can be disposed below the coplanar datum surface 123 of the flange 121. The coplanarity of the first terminals 22A, the second terminals 22B, the third terminals 22C and the fourth terminals 22D can be improved by introducing the coplanar datum surface 123. Particularly, all the first soldering portions 224A, the second soldering portions 224B, the third soldering portions 224C and the fourth soldering portions 224D are separated from the coplanar datum surface 123 of the flange 12 by the same distance D.

As shown in FIG. 2, FIG. 4 and FIG. 6, the major structural characteristics of this disclosure include: that the coplanarity of the soldering portions 224A, 224B, 224C, 224D of the terminals 22A, 22B, 22C, 22D is significantly improved by the coplanar datum surface 123 defined at the coplanar track 12 and the guiders 23A, 23B, 23C, 23D for positioning, and that, by providing the coplanar track 12 (including the stepwise top surface 124 and the coplanar datum surface 123) and the guiders 23A, 23B, 23C, 23D, the rear sections (soldering portions 224A, 224B, 224C, 224D of FIG. 6) of the terminals 22A, 22B, 22C, 22D protruding out of the corresponding guiders 23A, 23B, 23C, 23D can keep the distance D from the coplanar datum surface 123 of the flange 121 so as to ensure the soldering portions 224A, 224B, 224C, 224D to dispose on the same plane. Namely, the coplanarity of the terminals can be substantially improved.

Since manufacturing or pairing tolerance is always possible in producing or mounting the first guider 23A, the second guider 23B, the third guider 23C, the fourth guider 23D, the soldering portions 224A, 224B, 224C, 224D of the first terminals 22A, the second terminals 22B, the third terminals 22C and the fourth terminals 22D, and the flanges 121, a requirement of this disclosure is to keep the distance D within an allowable error margin, so that the following manufacturing process such as the SMT process can't be adversely affected.

In addition, the stepwise structure on the top surface 124 of the flange 121 (or the flange 122) can contribute to have the first guider 23A, the second guider 23B, the third guider 23C, the fourth guider 23D orderly to engage the flange 121, such that possible fitting problems caused by previous ill engagement of the guider and the flange can be avoided. In another embodiment, the flange 121 can keep the same thickness from the first end 125 to the second end 126. That is, the stepwise structure is not necessary. Further, the first groove 24A, the second groove 24B, the third groove 24C and the fourth groove 24D of the first guider 23A, the second guider 23B, the third guider 23C and the fourth guider 23D may also have the same height.

In summary, in the connector structure with improved terminal coplanarity provided by this disclosure, by utilizing the coplanar datum surface on the housing and the guiders for mounting the terminal assemblies, the mounting of the terminal assemblies can be unified and thus controllable, such that the coplanarity can be much improved.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A connector structure with improved terminal coplanarity, comprising:

a housing, having thereinside a plurality of sockets and a coplanar track disposed at a bottom thereof, the coplanar track being defined by two flanges disposed individually inside to two opposite lateral sides of the housing, each of the two flanges being longitudinally extended in a longitudinal direction and parallel to each other; and a plurality of terminal assemblies, each of the plurality of terminal assemblies including:

a connector body, disposed by the plurality of sockets;

a plurality of terminals, disposed by penetrating through the connector body; and a guider, disposed close to soldering ends of the plurality of terminals, the soldering end of each of the plurality of terminals protruding out of the guider, the guider having two opposite sides, each of the two opposite sides being furnished with a groove; wherein, when the guider is disposed at the coplanar track, each of the two grooves of the guider is engaged with the corresponding flange; wherein the coplanar track has a coplanar datum surface disposed on a bottom surface of the coplanar track; wherein soldering portions of the soldering ends of the plurality of terminals protruding out of the guider are separated from the coplanar datum surface by the same distance.

2. The connector structure with improved terminal coplanarity of claim 1, wherein the longitudinal direction of the soldering portion is parallel to a horizontal surface, and distances of the soldering portions to the coplanar datum surface of the flange are the same.

3. The connector structure with improved terminal coplanarity of claim 1, wherein the two flanges are symmetrically disposed to two opposite inner sides of the housing, and each of two opposite sides of the guider is furnished with the groove.

4. The connector structure with improved terminal coplanarity of claim 1, wherein the plurality of terminals are made of a conductive metal material.

5. The connector structure with improved terminal coplanarity of claim 1, wherein the housing, the connector body and the guider are made of a plastic insulation material.

6. The connector structure with improved terminal coplanarity of claim 1, wherein each of the two flanges extending in the longitudinal direction has oppositely a bottom surface and a top surface, the bottom surface is a plane, the bottom surface is the coplanar datum surface, and the soldering ends of the terminals of the terminal assemblies disposed below the bottom surface keep the same distance from the bottom surface.

7. The connector structure with improved terminal coplanarity of claim 6, wherein the top surface extends in the longitudinal direction in a stepwise manner, the flange extending in the longitudinal direction has oppositely a first end and a second end, and thickness of the flange is increasing from the first end to the second end.

8. The connector structure with improved terminal coplanarity of claim 7, wherein the flange, from the first end to the second end, is stepwise structured to have a plurality of thicknesses, the guiders of the corresponding terminal assemblies have different heights, and each of the heights of the corresponding grooves is fitted with one of the thicknesses of the flange.

9. The connector structure with improved terminal coplanarity of claim 8, wherein each of the thicknesses presents a tight fit with the groove of the corresponding guider of the respective terminal assembly.

* * * * *